US007040677B1

(12) United States Patent
Wickser, Jr.

(10) Patent No.: US 7,040,677 B1
(45) Date of Patent: May 9, 2006

(54) RETRIEVAL AND COLLECTION DEVICE

(76) Inventor: Robert Livingston Wickser, Jr., 1340 Leavenworth St., San Francisco, CA (US) 94109

( * ) Notice: Subject to any disclaimer, the term of this patent is extended or adjusted under 35 U.S.C. 154(b) by 0 days.

(21) Appl. No.: 10/905,723

(22) Filed: Jan. 18, 2005

(51) Int. Cl.
*A01K 29/00* (2006.01)
*E01H 1/12* (2006.01)

(52) U.S. Cl. ..... 294/1.4

(58) Field of Classification Search ..... 294/1.3, 294/1.4, 1.5, 50.9, 55; 15/104.8, 257.1
See application file for complete search history.

(56) References Cited

U.S. PATENT DOCUMENTS 3,446,525 A * 5/1969 Jones ..... 294/1.4
4,014,584 A * 3/1977 Bau ..... 294/1.4
4,179,145 A * 12/1979 Shinsako ..... 294/1.4
4,225,174 A * 9/1980 Hennessy et al. ..... 294/1.4
4,477,111 A * 10/1984 Crooks ..... 294/1.4
5,350,208 A * 9/1994 Heinrichson ..... 294/1.4
5,503,442 A * 4/1996 Lee ..... 294/1.4
6,062,168 A * 5/2000 Host et al. ..... 119/161
6,068,311 A * 5/2000 Jones ..... 294/1.4

FOREIGN PATENT DOCUMENTS

WO WO 93/13268 * 7/1993 ..... 294/1.4

* cited by examiner

*Primary Examiner*—Dean J. Kramer
(74) *Attorney, Agent, or Firm*—Thomas M. Freiburger

(57) ABSTRACT

A device for retrieving and disposing of solid or semi-solid waste such as dog waste comprising an elongated handle and a hinged bag supporting frame that is operated by a mechanism in the handle. A bag can be inserted over the two halves of the bag-supporting frame creating a cavity or depression, which will cause the waste to be trapped in the cavity or depression when the frame pivots to a closed position, after which the bag can be removed inside-out.

10 Claims, 3 Drawing Sheets

RETRIEVAL AND COLLECTION DEVICE

BACKGROUND OF THE INVENTION

1. Field of Invention

This invention relates to waste, specifically to an improved way of retrieving, and collecting dog waste.

2. Description of Prior Art

Waste is retrieved, and collected in various ways. The preferred method for collecting dog waste is picking it up by hand with a plastic bag over the hand or by using a shovel like device. There are many different Patented methods for dealing with dog waste, but not one deals with the problem of dog excrement in a convenient enough way to be widely used. This device utilizes the best attributes of both methods, so that the user has the convenience of a shovel with the protective benefits of a plastic bag. Although there have been several attempts at solving this problem, none do it as efficiently and effortlessly as my invention.

U.S. Pat. No. 3,677,596 (1972), issues to Yonaites, discloses a caddy for collecting refuse by holding a plastic bag open by a wire frame, which requires mater to be swept into the open bag. This device does not use a bag to form a closed pocket, nor does it utilize a jaw-like mechanism to collect and trap and material when the release mechanism is activated. U.S. Pat. No. 3,868,135 (1975), issued to Magliaro, discloses a device that is used for collecting animal waste that has a cable mechanism located at one end of the device that closes a hinged collector that contains a bag to trap the material. This device requires the use of a nonstandard bag that is inserted inside of the device. Also, the device utilizes a solid shovel-like configuration that collects mater with a scooping, rather than jaw-like encapsulation.

U.S. Pat. No. 4,383,710 (1983), issued to Fehr, discloses a device that collects animal waste with a scissor like set of jaws, which are inserted, into a bag. This device requires a new bag for each use; otherwise the previously collected mater will fall out, and is of a fixed length. U.S. Pat. No. 4,875,729 (1989) and U.S. Pat. No. 4,400,572 (1995), both issued to Peck, disclose simple devices for collecting animal waste with a wire frame surrounded by a plastic bag and a hand held wand which is necessary for retrieval of the material. The operation of these devices require that the user has to bend or stoop and get very close to the material, as if he were using his hand inside of a bag.

None of the aforementioned patents teach the use of a collection device that does not require bending, is collapsible, can use one bag for multiple collections, contains the mater in a closed bag and completely protects the device and the user from contamination.

SUMMARY OF THE PRESENT INVENTION

The present invention discloses a novel retrieval, and collection device that manipulates a bag with two opposing rotating oval shaped loops in a way that allows the user to deal with the problem of retrieving and collecting dog excrement or similar material with an ease and convenience previously unknown. The device picks up the mess with efficiency and stores the waste securely without the need to stoop or bend. This invention allows the bag to be easily removed without contaminating the hand, or the device.

DETAILED DESCRIPTION OF THE PREFERRED EMBODIMENTS

While describing the invention and its embodiments various terms will be used for the sake of clarity. These terms are intended to not only include the recited embodiments, but also all equivalents that perform substantially the same function, in substantially the same manner to achieve the same result.

Figure 1:
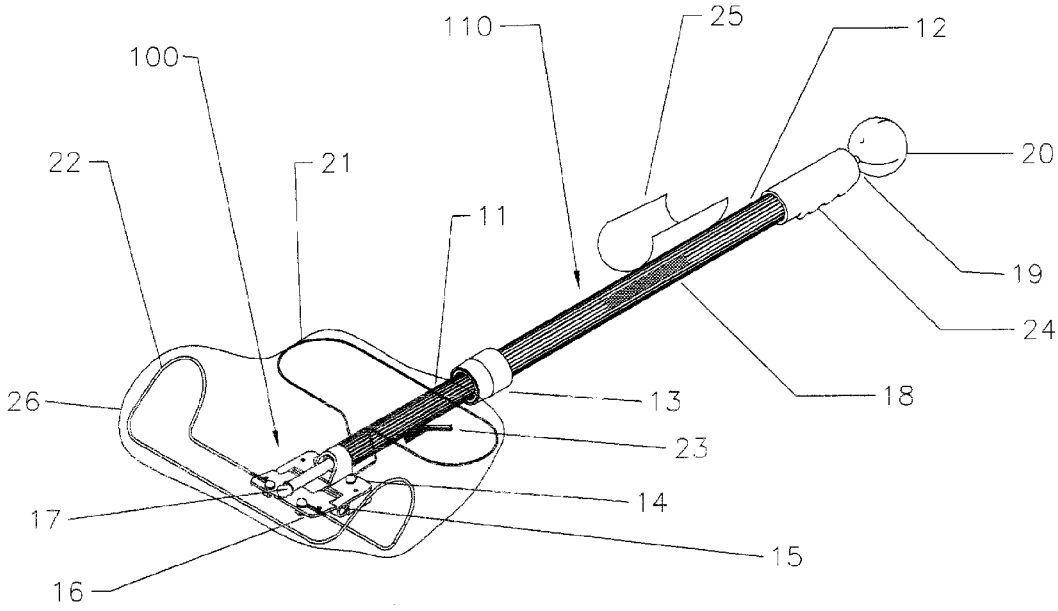
FIG. 1 is a perspective view of the retrieval and collection device in the open position.

One embodiment of the waste retrieval and collection device referenced in FIG. 1 comprises: one hollow internal tube handle 11 inserted into an external hollow tube handle of slightly larger inner diameter 12 so that this tube handle assembly 110 can be varied in length by either pulling the said tubes apart or pushing them together. Mounted on said hollow tube handle 12 is a clipping device, which may be used to attach various items, such as a flashlight, umbrella, additional bags, the dog or any item that the owner chooses. The length of said tube handle assembly 110 can be locked in place with a compression collar 13. The hollow internal tube handle 11 is attached to the upper hinge plate 14 of a spring loaded hinge assembly 100, which is comprised of an upper hinge plate 14, a lower hinge plate 16, and a spring 15. Within said tube handle assembly 110 is a series of three interconnected hollow tubes of lesser diameter that are telescopically nested 17,18,19, this assembly is connected to a ball handle 20 at the farthest end from the said hinge assembly 100.

When the said tube handle assembly 110 is collapsed to its shortest length the three telescoping tubes 17,18,19 are longer than the said tube handle assembly 110 and so exert pressure on the lower hinge plate 16 causing it to rotate approximately 90 degrees to an open position whereby both hinge plates are in the same plane. When the said tube handle assembly 110 is fully expanded the said telescoping tubes 17,18,19, collectively, are longer than the said tube handle assembly 110, so that the end of said telescoping tube 17 closest to the said spring loaded hinge assembly 100 holds the said spring loaded hinge assembly 100 in an open position. Pulling the ball handle 20 causes the said three telescoping tubes 17,18,19 to move relative to said lower hinge plate 16 allowing said spring loaded hinge assembly 100 to rotate to its closed position.

An oval shaped upper loop 21 of small diameter wire, plastic or similar material of sufficient size to accommodate the refuse is attached to the upper hinge plate 14.

A lower loop 22 constructed of small diameter wire, plastic or similar material shaped like half of a cylinder with an inner diameter greater than said upper loop 21 is attached to the lower hinge plate 16.

When the retrieval and collection device is in the open position a bag 26 is inserted over the two said loops 21 and 22 with the closed end of the bag in contact with the leading edge of the said lower loop 22 and the open end of the bag is either clipped to a clip 23 which is mounted on said hollow internal tube handle 111 or the said bag 26 may be wrapped said hollow internal tube handle 11, held in place by friction.

Figure 2:
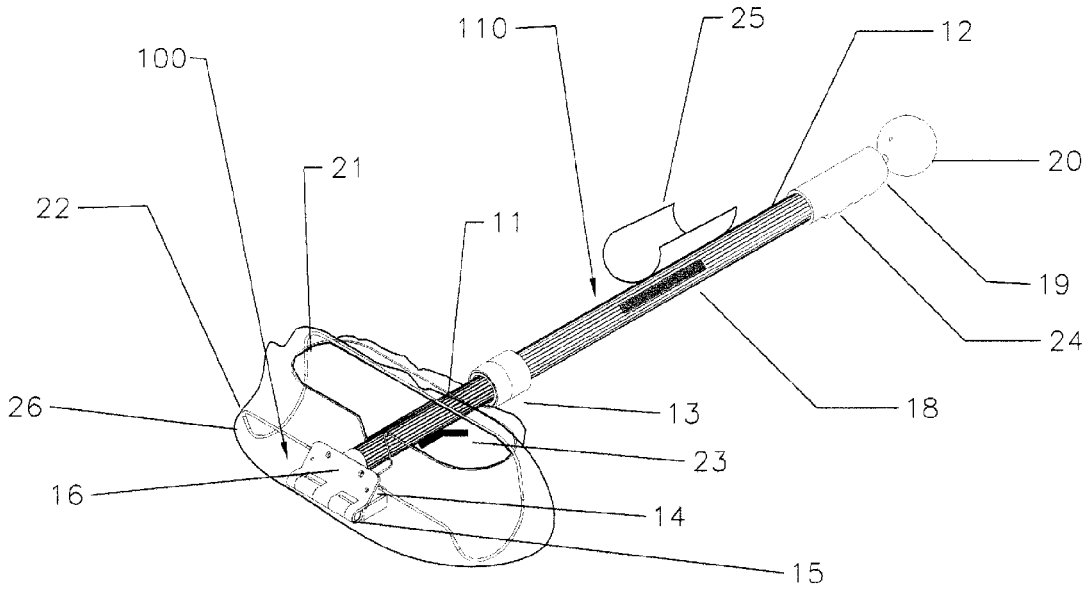
FIG. 2 is a perspective view of the device in the closed position.
Figure 3:
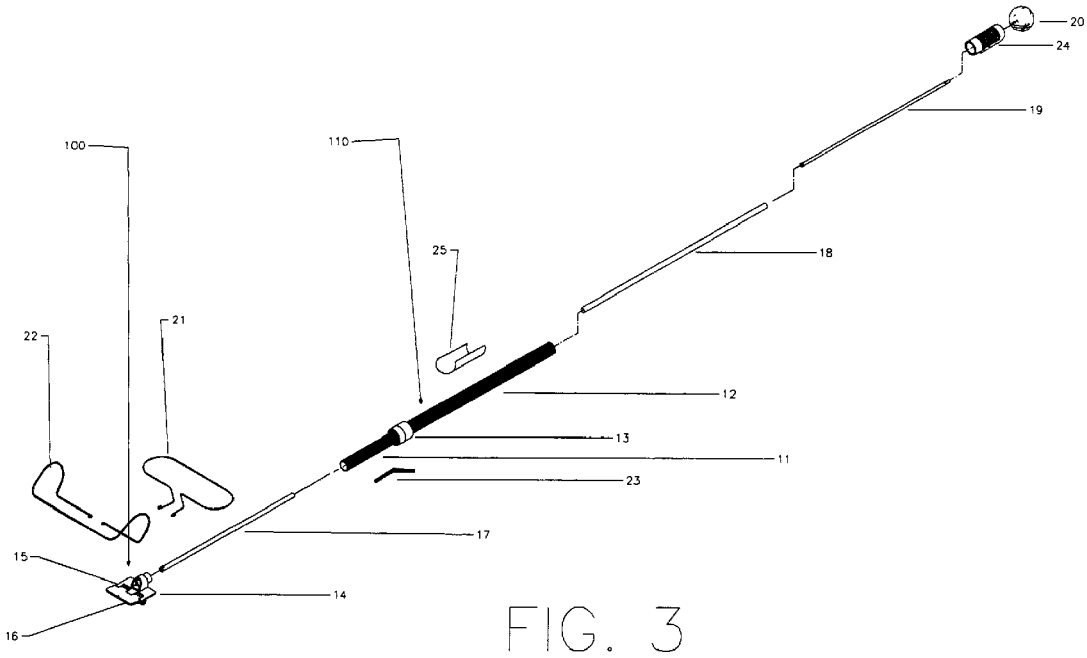
FIG. 3 is an exploded view of the device in the open position.

The said lower loop 22 encased by the said bag 26 acts as a shovel, spade or pocket to collect the mater. Once the mater is collected, pulling on the said ball handle 20 allows the spring loaded hinge assembly 100 to rotate closed, as depicted in FIG. 2. This action caused the said bag 26 to fold in half, entrapping the material inside of the upper loop 21 and inside of the bag.

The retrieval collection device may be reused until the bag is full. To dispose of the waste, peel the bag off of the upper loop 21 and the lower loop 22 while the device is in the closed position. To do this you must grasp the open end of the bag and pull away from the ball handle 20, which will turn the bag inside out encapsulating said waste without soiling the device or the user.

The invention has been described in terms of the preferred embodiment. One skilled in the art will recognize that it would be possible to construct the elements of the present invention from a variety of means and to modify the placement of the components in a variety of ways. While the embodiments of the invention have been described in detail and shown in the accompanying drawings, it will be evident that various further modifications are possible without departing from the scope of the invention as set forth in the following claims.

What is claimed is:

1. A refuse collecting device which can be used to pick up animal waste, comprising:

an elongated handle, a bag supporting member connected to a lower end of the handle with a bag pulled over the bag supporting member, the bag supporting member including a lower portion at a forward position and an upper portion positioned rear of the lower portion, the lower portion of the bag supporting member having a front edge which is thin and generally horizontal in use of the device and relatively stiff so that the lower portion in a first position, with the bag attached, can be held obliquely to a surface and pushed against and under a piece of refuse lying on the surface to pick up the refuse in the manner of a shovel and to carry the refuse on top of and on the outside of the bag, supported by the lower portion, the lower portion of the bag supporting member having raised side edge portions so as to shape the bag to have an upwardly concave surface for catching the refuse, the upper portion of the bag supporting member being connected to the elongated handle in an orientation to define an inclined support which is generally horizontal when the elongated handle is horizontal, and the bag extending over the upper portion, and folding means for pivoting the lower portion of the bag supporting member back on the handle to fold the bag back over upon itself along a generally horizontal hinge axis to a second position so as to trap the picked up refuse between two opposed surfaces of the bag and to transfer the refuse to a bag surface supported by the upper portion, and such that the bag can be stripped off the bag support member with the refuse between the said opposed surfaces to turn the bag inside out with the refuse captured in the bag.

2. The device for refuse collection according to claim 1, wherein said elongated handle is collapsible, telescopically.

3. The device for refuse collection according to claim 1, that is non electrically conductive.

4. The device for refuse collection according to claim 1, further including a clip on the handle to hold objects.

5. The device for refuse collection according to claim 1, wherein the raised side edge portions are generally semi-circular as viewed from a side of the device.

6. The device for refuse collection according to claim 1, wherein the lower portion is in the form of a loop, the lower, forward loop having said raised side edge portions and being pivotable along said generally horizontal hinge access, and the lower loop being swingable up and back via said folding means to the second position directly over said upper portion, whereby the refuse collected on the bag of the lower loop can be transferred to the surface of the bag at said upper portion and can be stored there while the lower loop is swung to the first position and used to pick up further refuse.

7. The device for refuse collection according to claim 6, wherein said upper portion of the bag supporting member comprises a loop, whereby the upper portion loop with the bag acts as an upper pocket into which the refuse is transferred.

8. The device for refuse collection according to claim 6, wherein the loop comprising the lower portion comprises formed wire, with a relatively stiff front forming said front edge of the bag supporting member.

9. The device for refuse collection according to claim 8, wherein the upper portion of the bag supporting member comprises a wire loop, stationary in position relative to the handle.

10. The device for refuse collection according to claim 9, wherein the lower and upper loops are formed of rigid metallic wire.

* * * * *